US006782217B1

(12) United States Patent
Ando

(10) Patent No.: US 6,782,217 B1
(45) Date of Patent: Aug. 24, 2004

(54) IMAGE FORMING DEVICE WHICH DETECTS AND PROCESSES CONTROL DATA ON ORIGINAL DOCUMENT

(75) Inventor: Hironori Ando, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 10/248,748

(22) Filed: Feb. 14, 2003

(51) Int. Cl.[7] ..... G03G 21/02; G03G 21/04
(52) U.S. Cl. ..... 399/79; 399/80; 399/366
(58) Field of Search ..... 399/79, 80, 82, 399/83, 84, 366, 8

(56) References Cited

U.S. PATENT DOCUMENTS 5,444,779 A * 8/1995 Daniele ..... 399/366
5,604,596 A * 2/1997 Ukai et al. ..... 358/296
5,640,253 A * 6/1997 Uchida et al. ..... 358/501
5,982,956 A * 11/1999 Lahmi ..... 382/306
5,999,766 A * 12/1999 Hisatomi et al. ..... 399/80
6,175,714 B1 * 1/2001 Crean ..... 399/366
6,647,126 B1 * 11/2003 Wen ..... 382/100

FOREIGN PATENT DOCUMENTS

JP H07-154586 A 6/1995
JP 2000-336833 12/2000

* cited by examiner

*Primary Examiner*—Robert Beatty
(74) *Attorney, Agent, or Firm*—Shinjyu Global IP

(57) ABSTRACT

An image forming device that forms images of original documents having both image data and control data thereon is disclosed, and is comprised of an original document reading means which includes a CCD, a control data extraction means, and a processing means. The original document reading means reads the image data and the control data on an original document. The control data extraction means extracts the control data from the data read by the original document reading means. The processing means processes the image data read by the original document reading means and forms an image thereof based upon the control data extracted by the control data extraction means. This image forming device can be used to prohibit the unauthorized copying of certain documents.

8 Claims, 6 Drawing Sheets

IMAGE FORMING DEVICE WHICH DETECTS AND PROCESSES CONTROL DATA ON ORIGINAL DOCUMENT

BACKGROUND OF INVENTION

1. Field of the Invention

The present invention relates to an image forming device, and more particularly to an image forming device that forms an image of an original document that has both image data and control data thereon.

In addition, the present invention relates to an information management device, and more particularly to an information management device capable of transmitting data to and receiving data from an image forming device that forms an image of an original document that has both image data and control data thereon.

Furthermore, the present invention relates to a system that comprises the image forming device and information management device noted above.

2. Background Information

A conventional copying machine that includes a copy prevention function is disclosed in Japanese Published Patent Application No. H07-154586. This device allows copies produced thereby to be traced in order to prevent one from counterfeiting paper currency by making color copies thereof. More specifically, this device adds tracking data to each copy, such as the serial number of the device and the date that the copy was produced, in the form of a yellow image that is difficult to detect with the naked eye.

In addition, another conventional technology that is well-known in the art is a copying machine that restricts special documents, such as paper currency, from being copied. An example of this technology is disclosed in Japanese Published Patent Application No. 2000-338833. When a special document such as paper currency is read into the device, it is compared to special document image data that has been preloaded in a memory means disposed in the device. If the image that was read in is determined to be a special document such as paper currency, the device will attempt to prohibit an unauthorized copy from being produced by storing data (such as fingerprint data) that uniquely identifies the individual who is operating the copying machine.

The copying machine that is disclosed in Japanese Published Patent Application No. 2000-338833 can effectively restrict copying when the original document to be copied is a special document like paper currency. In other words, this copying machine can restrict copying because image data on special documents such as paper currency can be preloaded therein.

However, the need to restrict copying is not limited to special documents. For example, there is a need to prevent one from making an unlimited number of copies of a publication protected by copyright (hereinafter referred to as "copyrighted material"). In addition, there are situations in which people at or above a certain rank within a company are authorized to copy internal corporate documents, but others in the company below that rank are not authorized to do so. However, the conventional technology described above is not capable of restricting copying in this manner.

In addition, there are situations in which copyrighted materials can be copied by paying a fee. The problem in these situations, however, is determining how much to charge. For example, one could leave this matter to the staff of the business in which the copying machine is located (e.g., a convenience store), but it will be burdensome for these individuals to calculate what fees should be charged for what type of copyrighted material.

The same problems exist when one uses an image forming device such as a printer or facsimile device to print an image that was scanned by a network connected scanner.

SUMMARY OF INVENTION

It is an object of the present invention to prohibit the unauthorized copying of both standard original documents and special original documents, and to make the process of restricting the copying of both types of original documents easier.

It is another object of the present invention to make the process of calculating the fees for copying copyrighted material easier.

In one aspect of the present invention, an image forming device forms images of original documents that have image data and control data, and is comprised of an original document reading means, a control data extraction means, and a processing means. The original document reading means reads the image data and control data on an original document. The control data extraction means extracts control data from the data read by the original document reading means. The processing means processes the image data read by the original document reading means and forms images based upon the control data extracted by the control data extraction means.

Original documents that are used in this device have image data and control data printed thereon. The image data and control data on each original document are read by the original document reading means. Control data is extracted from the data read from each original document, and the image forming process proceeds based upon this control data.

A variety of image forming processes can be easily conducted because control data is printed on each original document, the control data is read by the original document reading means, and the image forming process proceeds based on this control data.

In another aspect of the present invention, the control data serves to restrict the image forming process, and the processing means restricts the image forming process based upon the control data.

This makes it easier to restrict a variety of image forming processes.

In another aspect of the present invention, the control data serves to prohibit the image forming process, and the processing means prohibits the image forming process based upon the control data.

This not only makes it easier to prohibit the unauthorized image formation of special original documents such as paper currency, but also to prohibit the unauthorized image formation of general original documents.

In another aspect of the present invention, the image forming device further comprises an identification data acquiring means for acquiring identification data on the operator who is conducting image formation. In addition, the control data allows only pre-registered operators to conduct image formation, and the processing means proceeds with image formation only when the identification data acquired by the identification data acquiring means matches the pre-registered data.

Here, only the operators whose identity match a pre-registered list are allowed to conduct image formation. In addition, it is possible to restrict those pre-registered operators such that they are only authorized to produce images of certain original documents. This makes it easy to restrict a variety of image forming processes.

In another aspect of the present invention, the control data indicates that the image formation history of an original document is to be printed onto a copy thereof when image formation takes place, and the processing means both forms an image of an original document and prints the image formation history based upon the control data.

Here, the image formation history can be used because it is printed onto a copy of an original document. For example, this makes it easy to restrict the number of times an image of an original document can be formed.

In another aspect of the present invention, the image forming device further comprises a detection means that detects the number of times that the image forming process has occurred with respect to one original document, and the control data serves to authorize the image forming process to occur only a predetermined number of times with respect to one original document. In addition, the processing means executes the image forming process only when the number of times the image forming process has occurred with respect to one original document does not exceed a predetermined number.

This makes it easier to restrict the number of times the image forming process can be executed with an original document.

In another aspect of the present invention, the processing means subtracts the value 1 from the authorized number of times each time the image forming process has been executed for the original document, prints the remainder on each image of the original document formed during the image forming process, and restricts the number of images that can be formed from each image of the original document based upon the remainder printed thereon.

This allows the image forming device to easily restrict the number of times the image forming process is executed for copies of an original document by simply reading the original document and copies thereof.

In another aspect of the present invention, the control data indicates that the image forming process requires a fee to be paid, and further comprises a payment confirmation means that confirms that payment has been received from the operator conducting the image forming process. In addition, the processing means executes the image forming process after confirmation by the payment confirmation means.

This allows the operator of the image forming device to reduce his or her workload, because the image forming device will record the image forming fee data and the payment confirmation.

In another aspect of the present invention, the image forming device further comprises a fee recording means that records the image forming fee in accordance with the original document, and a display means that displays the fee charged. In addition, the control data includes data for displaying the image forming fee on the display means.

As noted above, this allows the operator to reduce his or her workload.

In another aspect of the present invention, an information management device is disclosed which is capable of transmitting data to and receiving data from an image forming device that forms images of original documents having control data included in the image data thereon. The information management device comprises a receiving means which receives data from the image forming device, a storage means that stores data associated with the image forming device, a control means that acquires data to be transmitted to the image forming device based upon data stored in the storage means in accordance with data from the image forming device, a transmission means that transmits the data acquired by the control means to the image forming device, and a management means that manages data related to the image forming process executed in the image forming device.

When the information management device receives data from the image forming device, data to be transmitted to the image forming device is produced in accordance with the data received from the image forming device, and the data produced thereby is transmitted to the image forming device. In addition, the information management device manages data related to the image forming process that is executed in the image forming device.

It will not be necessary for the image forming device to have a large volume of data and/or programs when controlling the variety of image forming processes therein, and thus the burden on the image forming device will be reduced.

In another aspect of the present invention, the storage means stores data on the operators who are authorized to operate the image forming process in the image forming device, the receiving means receives data related to the person operating the image forming device, the control means produces authorized/not authorized signals that indicate whether or not the operator operating the image forming device is an authorized operator based upon the data related to the person operating the image forming device, and the transmission means transmits the authorized/not authorized signals.

A large volume of data on operators can be stored together in the information management center. This feature is convenient in situations in which there are a large number of operators in an organization who are operating a large number of image forming devices therein.

In another aspect of the present invention, the storage means stores data on the fees related to the image forming processes in the image forming device, the receiving means receives processing data from the image forming device, the control means produces fee data based upon the processing data, and the transmission means transmits data the fee data in the image forming device. In addition, the information management device further comprises a means for transmitting data on fee collection that is based upon the fee data.

The information management device stores data on the fees related to the image forming processes in the image forming device, and produces fee data based upon the processing data when the processing data is sent from the image forming device. The fee data is displayed in the image forming device.

In addition, the information management device further comprises a means for transmitting data on fee collection that is based upon the fee data. Thus, for example, data on the fees to be withdrawn from an operator's bank account can be sent to that bank, and those fees can be collected therefrom.

In another aspect of the present invention, an image formation/information management system comprises any one of the image forming devices of the present invention described above, and any one of the information management devices of the present invention described above.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF DRAWINGS

Referring now to the attached drawings which form a part of this original disclosure.

DETAILED DESCRIPTION

Preferred embodiments of the present invention are described in detail below with reference to the figures.

1. Structure of the Copying Machine

Figure 1:
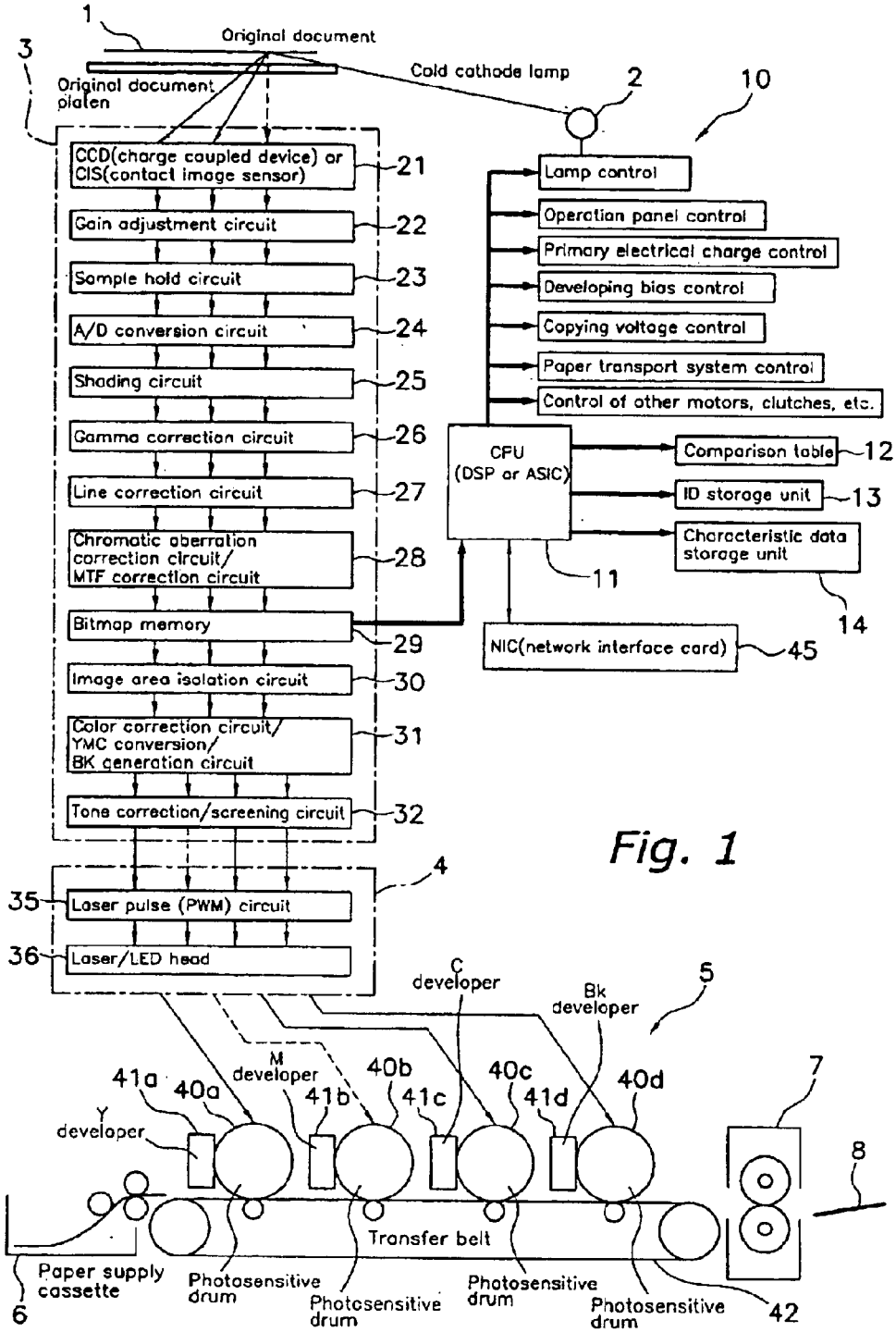
FIG. 1 is a conceptual diagram showing a copying machine according to one embodiment of the present invention.

FIG. 1 is a conceptual view of a full color copying machine according to one embodiment of the present invention.

This copying machine 10 includes an original document platen 1 on which an original document can be mounted, a cold cathode lamp 2 (such as a fluorescent lamp) that scans an original document mounted on the document platen 1, a data processing means 3 that reads the light reflected from the original document during scanning and processes the data therefrom, a laser device 4 that emits laser light in accordance with the data processed by the data processing means 31 and an image forming unit 5 that forms a color image in accordance with the laser light from the laser device 4. In addition, the copying machine 10 further includes a paper supply cassette 6 that stores paper to be supplied to the image forming unit 5, a fixing unit 7 for fixing an image transferred to the surface of a sheet of paper, and a discharge tray 8. Furthermore, the copying machine 10 is connected to a CPU 11 that receives data from the data processing means 3 and controls the activities of each unit in the copying machine 10, a comparison table 12 which stores specified data on special images or special documents and the like, an ID storage unit 13 that stores the IDs of all the individuals who are authorized to operate the copying machine 10, and a characteristic data storage unit 14 that stores characteristic data which controls copying in association with the specified data.

The data processing means 3 includes a CCD 21, a gain adjustment circuit 22, a sample hold circuit 23, an A/D conversion circuit 24, a shading circuit 25, a gamma correction circuit 26, a line correction circuit 27, a chromatic aberration correction circuit/MTF correction circuit 28, a bitmap memory 29, an image area isolation circuit 30, a color correction circuit/YMC conversion/BK generation circuit 31, and a tone correction/screening circuit 32.

In the data processing means 3, the light reflected from the original document is received in the CCD 21 and is converted to RGB analog signals. The RGB analog signals are then transmitted from the CCD 21 to the gain adjustment circuit 22, which then sets the optimal amplification factor for each color and amplifies the signals in order to conform them to the timing range of the A/D conversion circuit 24. In addition, analog data (voltage) stored in the sample hold circuit 23 is converted to digital data by the A/D conversion circuit 24. Furthermore, the shading circuit 25 corrects the harmful effects to picture quality created by such things as a non-uniform amount of light from the cold cathode lamp, and the gamma correction circuit 26 carries out a correction in order to conform the characteristics of the CCD to those of the human eye. Next, the line correction circuit 27 carries out a line correction so that the R, G and B data in the same area on an original document will be output simultaneously. The chromatic aberration correction circuit/MTF correction circuit 28 carries out a process to suppress degradation in character reproduction caused by using an optical lens, and also carries out an edge emphasis process to suppress degradation in MTF (resolving power) caused by the aforementioned process. The image data obtained in this manner is stored in the bitmap memory 29.

Furthermore, in the data processing means 3, the image area isolation circuit 30 distinguishes between each character/picture/halftone dot, for example, and optimizes the image at each one of these points. After the image data is optimized in this manner, the color correction circuit/YMC conversion/BK generation circuit 31 converts each type of data to Y, M, C and Bk. Then, the tone correction/screening circuit 32 carries out a process to improve the tone.

The laser device 4 includes a laser pulse circuit 35 that conducts laser pulse modulation based upon the data obtained from the data processing means 3, and a laser 36 that is driven by the output from the laser pulse circuit 35. Note that a LED head or an ink jet may be substituted for the laser device 4.

In addition, the image forming unit 5 includes photosensitive drums 40*a*, 40*b*, 40*c*, and 40*d* respectively used to produce Y (yellow), M (magenta), C (cyan), and Bk (black), developing units 41*a*, 41*b*, 41*c*, and 41*d* which serve to develop electrostatic latent images formed on the surface of each photosensitive drum, and a rotating transfer belt 42 disposed such that it faces a surface of each photosensitive drum.

The CPU 11 controls how the cold cathode lamp 2 is driven, controls the operation panel, controls the primary electrical charge placed on the photosensitive drums, controls the developing bias, controls the copying voltage, controls the paper transport system, and controls other motors, clutches, and the like.

2. Network System

The copying machine 10 further includes a NIC (network interface card) 45 for connecting to a standard network. The copying machine 10 uses the NIC 45 to transmit image data stored in the bitmap memory 29 to the network, or to receive such data from the network.

Figure 2:
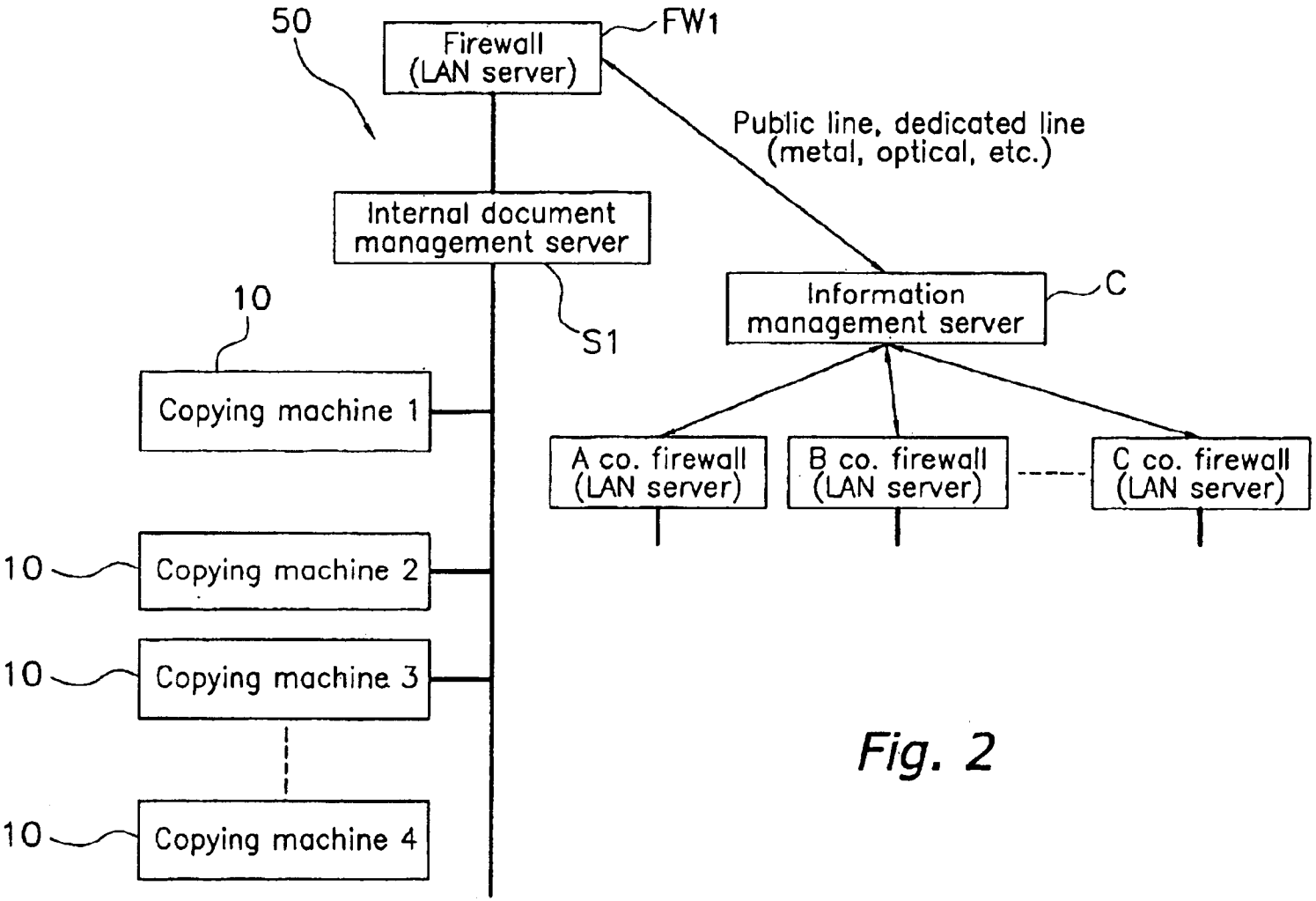
FIG. 2 shows the structure of a system that includes the copying machine shown in FIG. 1.

FIG. 2 shows the conceptual structure of a network system that includes an internal corporate LAN 50 that is connected to a plurality of copying machines 10, and an information management center C that is connected to a plurality of other internal corporate LANs.

As shown in FIG. 2, each copying machine 10 in the internal corporate LAN 50 is connected to a document management server S1 via a cable, and each copying machine 10 is networked with each other via the document management server S1. The information management center C is connected to the internal corporate LAN 50 via a LAN server (firewall) FW1, and can be located a considerable distance away from the internal corporate LAN 50 if so desired.

3. Original Documents

The copying machine of the present embodiment not only handles standard original documents that have only image data thereon, but also handles original documents having specified data thereon that serves to restrict the copying thereof. Specified data includes, but is not limited to, data which will control the unauthorized copying of original documents such as paper currency and the like, data which restricts the individuals who are authorized to make copies of internal corporate documents and the like, data which causes the copy history of an original document to be printed out on a copy thereof, and data which authorizes one to make one or more copies of copyrighted material by paying a fee. The specified data is, for example, displayed by placing yellow data that is not image data in the image data on an original document according to a predetermined set of rules. This can be accomplished, for example, by adopting the method disclosed in Japanese Published Patent Application No. H07-154586. Of course, the specified data can also be displayed by employing a bar code or the like that is placed outside the area on which the image data is displayed on the original document. In addition, paper currency from a number of different countries will have a variety of security features included in the images thereon that can serve as specified data.

4. Control Processes a. Overall control process

Figure 3:
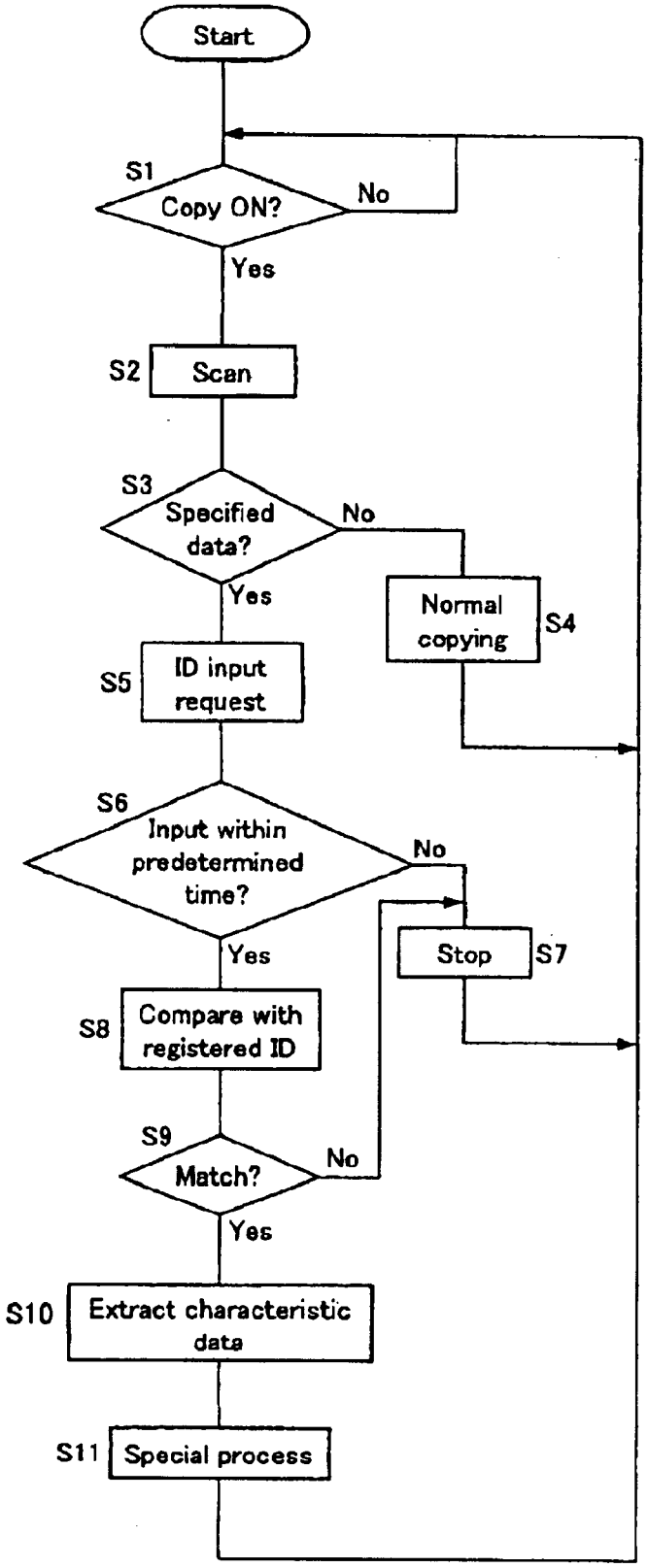
FIG. 3 is a flowchart showing a control process of the copying machine shown in FIG. 1.

The overall control process will be described below with reference to the flowchart in FIG. 3.

First, in Step S1, it is determined whether or not the copy button on the operation panel has been pushed. If the copy button has been pushed, the process moves to Step S2, scanning begins by means of the CCD 21 and the like, and the image of the original document captured thereby is stored in the bitmap memory 29. The CCD 21 reads the R, G, and B color data, and thus the data stored in the bitmap memory 29 corresponds to R, G, and B.

Next, in Step S3, the specified data is extracted. The specified data can be extracted by means of any well-known extraction process that is capable of extracting only specified data stored in the bitmap memory 29. In addition, the specified data on an original document can be read out with a bar code reader in situations in which the specified data is stored thereon by means of a bar code. The process in Step S3 will then determine whether or not the specified data on the original document matches any of the pre-registered specified data listed in the comparison table 12. If there is no match, the process moves to Step S4 and normal copying proceeds. However, if any of the specified data extracted from the original document does match any of the specified data in the comparison table 12, the process moves from Step S3 to Step S5.

In Step S5, the person operating the copying machine is asked to input his or her ID number on the monitor of the operation panel. For example, the message "Please input your ID number" will be displayed on the monitor. A variety of other data could be used to identify the operator, such as a voice print, a fingerprint, an IC card, or the like.

Next, in Step S6, it is determined whether or not the operator has input his or her ID within a predetermined period of time. If the ID is not input within the predetermined period of time, the process moves to Step S7 and terminates. If the ID is input within the predetermined period of time, the process moves to Step S8 and the input ID is compared to the IDs stored in the ID storage unit 13. In Step S9, it is determined whether or not the ID that was input matches one of the IDs stored in the ID storage unit 13. If the ID that was input does not match one of the IDs stored in the ID storage unit 13, the process moves to Step S7 and terminates.

If the ID that was input does match one of the IDs stored in the ID storage unit 13, the process moves from Step S9 to Step S10, and characteristic data that is associated with the aforementioned specified data is extracted from the characteristic data storage unit 14. Characteristic data is data that determines what the steps in the remaining portion of the copying process will be, is determined by the specified data in an original document, and is made up of commands. Thus, in Step S11, a special process will be executed based upon the characteristic data extracted from characteristic data storage unit 14.

b. Special process

Figure 4:
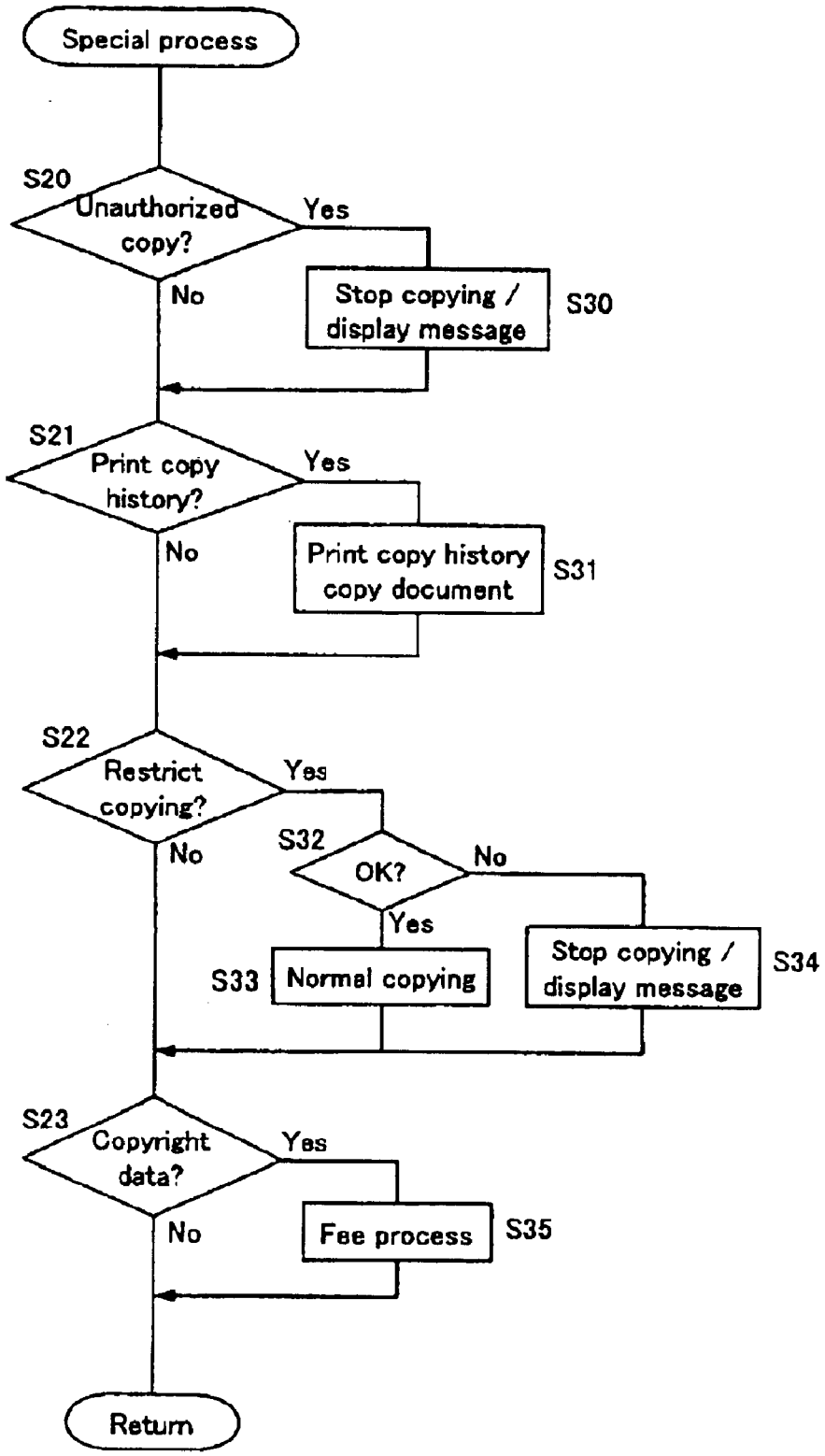
FIG. 4 is a flowchart showing a special process of the copying machine shown in FIG. 1.

FIG. 4 shows a flowchart describing the special process.

The special process is determined by the characteristic data, and the copying process is then executed in accordance with this determination. In other words, the characteristic data will, in association with the specified data, determine whether or not copying is authorized or not in Step S20, determine whether or not the copy history is to be printed onto a copy of the original document in Step S21, determine whether or not copying is to be restricted to certain individuals in Step S22, and determine whether or not copyrighted material is to be copied in Step S23.

For example, if one attempts to make a copy of paper currency, the special process will determine that copying is unauthorized due to the specified data displayed on the paper currency. Thus, in this situation, the process will move from Step S20 to Step S30, a message such as "Cannot copy this document" will be displayed on the operation panel, and the special process will then terminate and return to the control process shown in FIG. 3.

In another example, if the only specified data on an original document indicates that the copy history is to be printed on a copy thereof, the special process will go to Step S20, recognize that the document is authorized to be copied (due to the absence of specified data thereon indicating that copying is unauthorized), and then move to Step S20. At Step S20, the specified data will indicate that the copy history is to be printed onto the copy of the document, and the process will then move to Step S31. At Step S31, the process will print information such as the number of times the original document has been copied and who copied it onto each copy. The special process will then terminate and return to the control process in FIG. 3, because there is no specified data on the document indicating that the document is copy restricted (Step S22) or that it is protected by copyright (Step S23).

In yet another example, if the only specified data on the original document indicates that copying is to be restricted in accordance with the person making the copies, then the special process will move through Steps S20 and S21 (because there is no specified data on the document indicating that copying is unauthorized or that the copy history is to be printed onto the copy), and then move to Step S22. At Step S22, the process will recognize that the document is copy restricted due to the specified data thereon, and then move to Step S32. At Step S32, the process will determine whether or not the ID of the operator that was input at Step S5 matches one of the IDs that are authorized to copy the original document. If the ID of the operator matches one of these authorized IDs, then the process moves from Step S32 to Step S33, a normal copying process is executed in Step S33, and the special process will then terminate and return to the control process in FIG. 3 because there is no specified data indicating that the document is copyrighted material. However, if the ID of the operator does not match one of these authorized IDs, then the process moves from Step S32 to Step S34, and as noted above, a message such as "Cannot copy this document" will be displayed on the operation panel, and the special process will then terminate and return to the control process in FIG. 3.

In yet another example, if the only specified data on the original document indicates that the original document is copyrighted material, then the process moves from Step S23 to Step S35, and the fee process is executed.

c. Fee process

Figure 5:
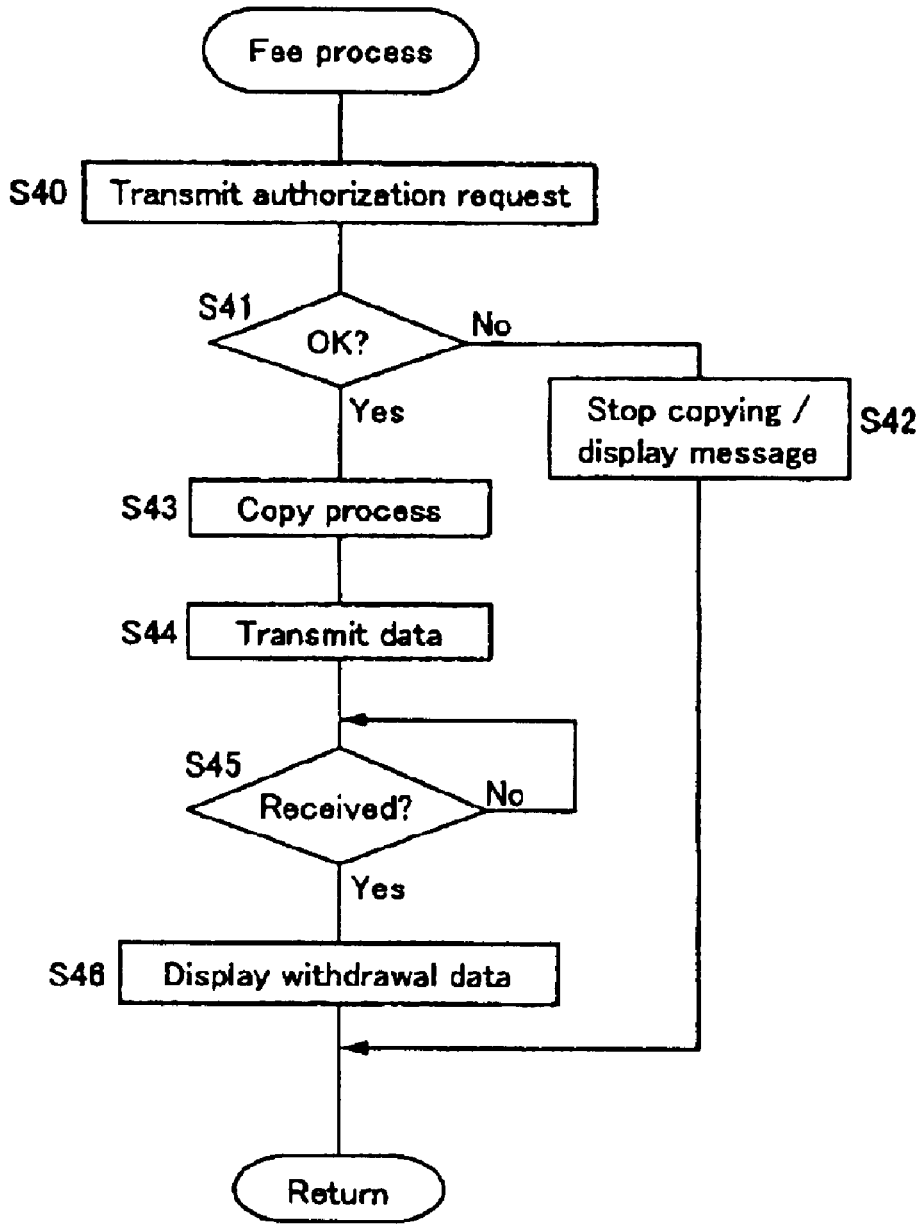
FIG. 5 is a flowchart showing a fee process of the copying machine shown in FIG. 1.
Figure 6:
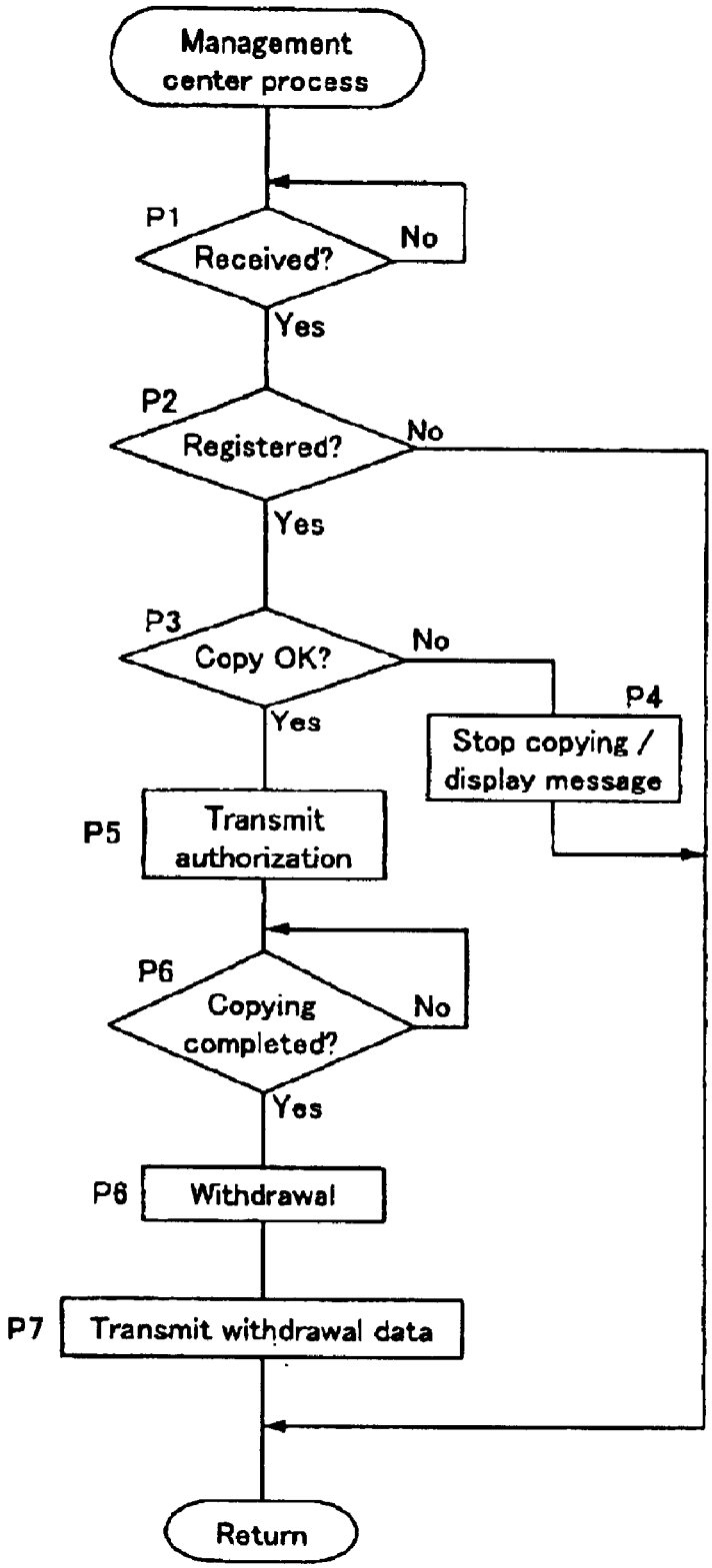
FIG. 6 is a flowchart showing a fee process in an information management center.

The fee process is carried out by sending data to and receiving data from the information management center C. FIG. 5 is a flowchart showing the fee process that occurs in the copying machine 10, and FIG. 6 is a flowchart showing the fee process that occurs in the information management center C. If the original document to be copied is protected by copyright, then it is possible to authorize copying thereof by paying a fee for this purpose. In addition, the collection of this fee will be carried out by the information management center C.

The information management center C manages such items as the fee to be charged for copying copyrighted material, the number of times a user is authorized to make such copies, and the like. Furthermore, users are registered with the information management center C, and only those registered users are authorized to make copies of copyrighted materials. In addition, data on each registered user (e.g., each registered user's bank account number from which the copying fees can be withdrawn, data on how many times each registered user has copied a particular copyrighted material, and the like) is stored in the information management center C in order to collect the copying fees therefrom. In this embodiment, a user is not one of the individuals who operate the copying machines 10, but is instead a group that is managed by the internal corporate document management server S1 shown in FIG. 2. In other words, a single user ID is assigned to each group (e.g., a corporation).

If copyrighted materials are to be copied in this environment, a request to authorize copying will be transmitted from the copying machine 10 to the information management center C in Step S4. In Step P1, the information management center C will determine whether or not an authorization request has been received from the copying machine 10. If an authorization request has been received in the information management center C, the process moves from Step P1 to Step P2, and it will then be determined whether or not the user making the request is registered in the information management center C. Although not shown in the figures, a process is executed which requests the user to register with the information management center C if the user is not registered.

If the user that transmitted the authorization request is already registered in the information management center C, then the process moves from Step P2 to Step P3. At Step P3, it is determined whether or not copying is authorized. As noted above, for each copyrighted material, the information management center C stores data on such things as how many copies one user is authorized to make and how much one copy will cost, and also stores the copying history for each user. Thus, this data is used in Step P3 to determine whether or not copying is authorized. For example, if the user that sent out the authorization request has already made the maximum number of copies they are authorized to make, the process will move from Step P3 to Step P4, and a message that informs them that further copying is not authorized will be transmitted to the user. However, if further copying is authorized, then the process will move from Step P3 to Step P4, and a message indicating that copying is authorized will be transmitted to the user.

Then, in Step P6, the process waits for a signal transmitted from the user that indicates that copying is completed.

On the user side, in Step S41 the process waits for a copy authorization signal to be sent from the information management center C. If Step P3 and Step P4 are executed and a signal indicating that copying is not authorized is sent from the information management center C, the process moves from Step S41 to Step S42, a message indicating that copying is not authorized is displayed on the operation panel, and the process terminates. If Step P5 is executed in the information management center C and an authorization signal is sent to the user, the process moves from Step S41 to Step S43, and the copyrighted material is copied in a normal fashion.

If copying has been completed, the process moves to Step S44. At Step S44, a signal indicating that copying has been completed, as well as data such as the number of copies made and the date on which they were made, are transmitted to the information management center C.

The information management center C receives the signal from the user indicating that copying has been completed and stores the data associated with the copy job, and the process moves from Step P6 to Step P7. At Step P7, the data transmitted from the user is used to calculate the copying fee, and a process is executed to withdraw the copying fee from that user's bank account. Then, the process moves to Step P8, and the withdrawal data is transmitted to the user.

On the user side, the process at Step S45 waits to receive data from the information management center C, and the information management center C executes Step P8. If the user receives the data, the process moves from Step S45 to Step S46. In Step S46, the withdrawal data transmitted from the information management center C is displayed on the operation panel, and thus allows the operator on the user side to confirm that the fee has been withdrawn.

5. Other Embodiments (a) If a user is authorized to make only one copy of copyrighted material, then making a copy of that one copy will typically not be authorized. Specified data for prohibiting the recopying of copyrighted material will be displayed on the copyrighted material together with the image data.

Accordingly, when a first copy of copyrighted material is made, copy history data can be printed onto that copy, as described in Step S31 of the previous embodiment, which indicates that the document is a copy of copyrighted material. This makes it possible to prohibit the copy itself from being copied.

In addition, consider an example in which a total of three copies of copyrighted material are authorized to be made. Here, for example, the phrase 3 copies allowed will be printed on the original version of the copyrighted material, that number will be reduced by one each time a copy is made of that document, and the result of that subtraction, e.g., the remaining number of authorized copies, can be printed on each authorized copy of the original. More specifically, in this example a the phrase 3 copies allowed will be printed on the original version of the copyrighted material. When one copy of this copyrighted material is made, the phrase 2 copies allowed will be printed on this first generation copy. Next, when a copy is made of this first generation copy, the phrase 1 copy allowed will be printed on this second generation copy. When a copy is made of this second generation copy, the phrase No copying allowed will be printed on this third generation copy, and thus copying of this third generation document will be prevented.

The control process in this situation is identical with the processes of Step S21 and Step S31 shown in FIG. 4.

(b) If the original document is copyrighted material, then it is preferable for the original and the copy to be clearly distinguishable from one another. Thus, as noted above, data indicating that a document is a copy of copyrighted material can be printed onto the document.

(c) In the previous embodiment, the comparison table 12, the ID storage unit 13, and the characteristic data storage unit 14 are provided in each copying machine 10. However, these items can be provided in the information management center C. Thus, when copying takes place at each copying machine, image data and the like obtained during scanning will be transmitted over the network to the information management center C, the various comparison processes will be executed in the information management center C, and based upon these results, details on the various control processes described above can be sent back to each copying machine.

(d) In the previous embodiment, the fee process is managed in the information management center C. However, the fee process can be stored in each copying machine, and can be executed by each copying machine as needed.

(e) The previous embodiment was primarily described as an internal corporate information management system. However, the system according to the present invention is not limited thereto. For example, the present invention can be applied in exactly the same way to a system in which a plurality of copying machines are placed in a plurality of convenience stores associated with a certain group, and which are networked with an information management center.

(f) In the previous embodiment described above, the original document was described as having only one specified data thereon. However, it will be readily apparent to one of ordinary skill in the art that the special process can be modified to accept original documents having multiple specified data thereon (e.g., an original document that is both protected by copyright and which can only be copied by certain individuals and/or groups).

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An image forming device that forms images of original documents that have both control data and image data thereon, comprising:

original document reading means that reads the image data and control data on an original document;

control data extraction means extracts the control data from the data read by the original document reading means; and processing means that processes the image data read by the original document reading means and forms images thereof based upon the control data extracted by the control data extraction means; and detection means that detects the number of times that the image forming process has occurred with respect to the original document;

wherein the control data serves to authorize the image forming process to occur only an authorized number of times with respect to the original document; and the processing means executes the image forming process only when the number of times the image forming process has occurred with respect to the original document does not exceed the authorized number of times.

2. The image forming device set forth in claim 1, wherein the control data serves to restrict the image forming process; and the processing means restricts the image forming process based upon the control data.

3. The image forming device set forth in claim 2, wherein the control data serves to prohibit the image forming process;

and the processing means prohibits the image forming process based upon the control data.

4. The image forming device set forth in claim 1, further comprising identification data acquiring means which acquires identification data on an operator who is conducing image formation with the image forming device;

wherein the control data allows only one or more preregistered operators to conduct image formation with the image formation device; and the processing means executes an image forming process only when the identification data acquired by the identification data acquiring means matches a preregistered operator.

5. The image forming device set forth in claim 1, wherein the control data directs the image forming device to print image formation history on an image of the original document while image formation takes place; and the processing means both forms an image of the original document and prints the image formation history of the original document on the image based upon the control data.

6. The image forming device set forth in claim 1, wherein the processing means subtracts the value 1 from the authorized number of times each time the image forming process has been executed for the original document, prints the remainder on each image of the original document formed during the image forming process, and restricts the number of images that can be formed from each image of the original document based upon the remainder printed thereon.

7. The image forming device set forth in claim 1, wherein the control data indicates that the image forming process requires an image forming fee to be paid;

the image forming device further comprises a payment confirmation means that confirms that the image forming fee has been received from an operator conducting the image forming process; and the processing means executes the image forming process after receiving confirmation from the payment confirmation means that the image forming fee has been received.

8. The image forming device set forth in claim 7, further comprising:

fee storage means that stores the image forming fee associated with the original document; and display means that displays the image forming fee;

wherein the control data includes data for displaying the image forming fee on the display means.

* * * * *